US010041243B2

(12) United States Patent
Walker

(10) Patent No.: US 10,041,243 B2
(45) Date of Patent: Aug. 7, 2018

(54) MODULAR BUILDING UNIT, SYSTEM AND METHOD

(71) Applicant: Venture Holdings B.V., Amsterdam (NL)

(72) Inventor: Mark Andrew Walker, Pretoria (ZA)

(73) Assignee: Venture Holdings B.V., Amsterdam (NL)

( * ) Notice: Subject to any disclaimer, the term of this patent is extended or adjusted under 35 U.S.C. 154(b) by 0 days.

(21) Appl. No.: 15/520,628

(22) PCT Filed: Oct. 21, 2015

(86) PCT No.: PCT/ZA2015/050014
§ 371 (c)(1),
(2) Date: Apr. 20, 2017

(87) PCT Pub. No.: WO2016/065373
PCT Pub. Date: Apr. 28, 2016

(65) Prior Publication Data

US 2017/0314253 A1 Nov. 2, 2017

(30) Foreign Application Priority Data

Oct. 21, 2014 (ZA) ..... 2014/07650

(51) Int. Cl.
*E04B 1/12* (2006.01)
*E04B 1/94* (2006.01)
(Continued)

(52) U.S. Cl.
CPC ..... *E04B 1/12* (2013.01); *E04B 1/40* (2013.01); *E04B 1/54* (2013.01); *E04B 1/6187* (2013.01);
(Continued)

(58) Field of Classification Search
CPC ..... E04B 1/12; E04B 1/14; E04B 1/54; E04B 2002/867; E04B 2/8629; E04B 2002/8676;
(Continued)

(56) References Cited

U.S. PATENT DOCUMENTS 2,284,229 A * 5/1942 Palmer ..... E04C 2/292 52/407.1
2,644,552 A * 7/1953 MacDonald ..... E04B 1/54 52/580
(Continued)

FOREIGN PATENT DOCUMENTS

WO 2009043830 A1 4/2009

*Primary Examiner* — Joshua J Michener
*Assistant Examiner* — Matthew J Gitlin
(74) *Attorney, Agent, or Firm* — The Webb Law Firm

(57) ABSTRACT

The invention is for a modular building unit (10, 200, 210) for use in constructing a building. The building unit (10, 200, 210) has a planar body (12) having two major side faces (12.1) and two ends (12.2) between each side face (12.1), and a connection interface (28, 30) provided at each of the ends, for connecting similar building units (10, 200, 210) with complemental connection interfaces. The body (12) comprises three walls (14, 16, 18) arranged side-to-side and transversely spaced from each other, the three walls (14, 16, 18) thus defining two planar spaces (20, 22) therebetween, and a plurality of reinforcing webs (24) in the first space, for providing structural support to the building unit (10, 200, 210). The second space (22) defines at least one hollow cavity for receiving a matched insulation insert (25) thereby to impart insulating properties to the building unit (10, 200, 210).

16 Claims, 14 Drawing Sheets

(51) Int. Cl.

| | |
|---|---|
| ***E04C 3/28*** | (2006.01) |
| ***E04B 7/02*** | (2006.01) |
| ***E04C 3/36*** | (2006.01) |
| ***E04B 1/61*** | (2006.01) |
| ***E04B 1/41*** | (2006.01) |
| ***E04B 1/76*** | (2006.01) |

(52) U.S. Cl.
CPC ..... *E04B 1/7604* (2013.01); *E04B 1/941* (2013.01); *E04B 7/026* (2013.01); *E04C 3/28* (2013.01); *E04C 3/36* (2013.01)

(58) Field of Classification Search
CPC . E04B 2/00; E04B 2/7401; E04C 2/34; E04C 2/20; E04C 2/22; E04C 2/296; E04C 2/36
USPC ..... 52/404.1, 404.3, 404.4, 407.1, 407.2, 52/407.3, 407.4, 426, 580, 588.1
See application file for complete search history.

(56) References Cited

U.S. PATENT DOCUMENTS 2,662,043 A * 12/1953 MacMillan ..... E04B 1/806 428/120
3,001,613 A 9/1961 McBerty
3,191,724 A * 6/1965 De Ridder ..... E04C 2/08 428/119
3,605,363 A * 9/1971 Bard ..... E04B 1/18 52/241
4,037,379 A * 7/1977 Ozanne ..... E04C 2/3405 52/404.3
4,180,956 A * 1/1980 Gross ..... E04B 2/32 52/407.1
4,433,522 A * 2/1984 Yerushalmi ..... E04H 9/10 52/249
4,443,987 A 4/1984 Erb
4,550,543 A 11/1985 Valenzano
4,677,798 A * 7/1987 Phillips ..... E04H 3/08 109/79
5,651,154 A * 7/1997 Ahlskog ..... E01D 19/125 14/6
5,740,648 A * 4/1998 Piccone ..... E04B 2/86 249/191
5,768,851 A * 6/1998 Nagaoka ..... E04B 1/6158 52/309.11
6,212,845 B1 4/2001 De Zen
6,219,984 B1 * 4/2001 Piccone ..... E02D 5/08 52/404.1
6,658,808 B1 * 12/2003 Doherty ..... E04B 1/12 52/579
6,668,512 B2 * 12/2003 Ray ..... E04B 5/19 52/843
6,918,221 B2 * 7/2005 Williams ..... E04B 5/026 52/578
7,559,176 B2 * 7/2009 Foell ..... E04B 2/8629 52/425
7,793,477 B1 * 9/2010 Potts ..... E04D 13/1643 52/144
7,797,897 B2 9/2010 Roth
8,322,115 B2 * 12/2012 Foell ..... E04B 2/8629 52/309.17
8,555,590 B2 * 10/2013 Richardson ..... E04B 2/8641 52/421
8,640,410 B2 2/2014 Bergeron
8,677,713 B1 * 3/2014 Sheehy ..... E04C 2/20 52/284
2002/0002804 A1 1/2002 Sheehy
2003/0009967 A1 * 1/2003 Piccone ..... E04B 1/12 52/426
2005/0016083 A1 1/2005 Morin et al.
2007/0062146 A1 * 3/2007 Van Dijk ..... E04B 1/12 52/580
2010/0212241 A1 8/2010 Holroyd
2011/0107702 A1 * 5/2011 Koikas ..... E04B 2/8629 52/426
2013/0097952 A1 * 4/2013 Flynn ..... E04C 2/543 52/309.1
2013/0192155 A1 * 8/2013 Bergeron ..... E04B 2/00 52/309.1
2014/0318062 A1 * 10/2014 Richardson ..... E04B 2/8635 52/309.1

* cited by examiner

MODULAR BUILDING UNIT, SYSTEM AND METHOD

CROSS-REFERENCE TO RELATED APPLICATIONS

This application is the United States national phase of International Application No. PCT/ZA2015/050014 filed Oct. 21, 2015, and claims priority to South African Patent Application No. 2014/07650 filed Oct. 21, 2014, the disclosures of which are hereby incorporated in their entirety by reference.

BACKGROUND OF THE INVENTION

Field of Invention

The present application relates to modular or prefabricated buildings. More particularly, it relates to a modular building unit, system and method, for example for modular prefabricated construction of houses, buildings, or like structures.

Description of Related Art

Plastic modules which fit together to form a building, like a house, are used in various industries. Use of plastic, specifically thermoplastic, is convenient because it is cheap to manufacture and handle. It can be designed to any shape which can practicably be moulded (e.g., using plastic extrusion and vacu-forming processes).

U.S. Pat. No. 7,797,897 discloses a system which includes a plurality of modular wall units which are interconnectable by means of joiner units. The wall units are planar and have a connection interface at each end. The connection interfaces are the same (e.g., female) and therefore cannot be directly connected to each other; they must be interconnected by means of the complemental joiner unit which has a pair of complemental connection interfaces (e.g., male).

U.S. Pat. No. 8,640,410 also discloses a similar modular wall unit. The wall unit of U.S. Pat. No. 8,640,410 is also planar, made of a plastic, and includes a connection interface at each end. However, the connection interfaces are not the same—they are complemental, e.g., one end has a female interface and the other end has a male interface. This permits the wall units to be connected directly to each other without the need for joiner units.

A potential drawback of these modular systems, and indeed all systems made of plastic, is that they lack certain characteristics required for building structures, e.g., insulation, and more specifically fire resistance. Building codes in many jurisdictions require that some walls, e.g., exterior walls, of buildings have a minimum amount of fire resistance. This necessitates cladding of the wall units, which adds to the cost of the building, adds to construction time, and increases the level of complexity of the assembly. The cladding may also impart other useful qualities, e.g., heat insulation, sound insulation, etc., depending on the cladding material used.

Metal building units, e.g., as disclosed in U.S. Pat. No. 3,001,613, may have some degree of inherent fire resistance but add other complexities, e.g., cost and manufacturing difficulties. The Applicant thus does not consider any metal modular building units to be of relevance to the present invention. Thus a modular building unit (and system formed therewith) is desired which has the advantages of plastic or polymer-based building units, but which has better insulating characteristics than other systems.

The Applicant thus desires a modular building unit (and system formed therewith) which has the advantages of plastic or polymer-based building units, but which has better insulating characteristics than other systems of which the Applicant is aware.

SUMMARY OF INVENTION

According to one aspect of the invention, there is provided a modular building unit made of a polymeric material and for use in constructing a building, the building unit including:

- a planar body having two major side faces and two ends between each side face; and
- a connection interface provided at each of the ends, thereby to connect similar building units with complemental connection interfaces, wherein the body further comprises:
- three walls (respectively a first side wall, a middle wall, and a second side wall) arranged side-to-side and transversely spaced a short distance from each other, the three walls thus defining two planar spaces therebetween, that is, a first space defined between the first side wall and the middle wall and a second space defined between the middle wall and the second side wall; and
- a plurality of reinforcing webs extending between the first side wall and the middle wall in the first space, thereby to provide structural support to the building unit,
- wherein the second space defines at least one hollow cavity extending across at least some of the building unit and operable to receive a matched insulation insert thereby to impart insulating properties to the building unit greater than those of the polymeric material alone.

In the context of this specification, the term "insulating" may refer generally to fire resistance. It may also refer to other characteristics, such as noise insulation. In the context of the three walls, the distance they are spaced apart is "short" relative to the height or length of the modular building unit.

All of the prior art building units (e.g., those of U.S. Pat. No. 7,797,897 and U.S. Pat. No. 8,640,410) of which the Applicant is aware comprise only two walls (and not three) with reinforcing webs extending between the two walls. The prior art building units therefore lack the second space.

The building unit (in accordance with the present invention) may be of PVC or of thermoplastic. The building unit may be manufactured by a plastic extrusion process or a moulding process. The invention thus extends to an extrusion and injection mould operable to extrude or mould the building unit in accordance with the present invention.

The building unit may be used for providing panels or walls and is further referred to as a panel unit for ease of explanation.

The walls may be unequally spaced apart. For instance, the first side wall and the middle wall may be spaced further apart than the middle wall and the second side wall. Consequently, the first and second spaces may be different thicknesses. For example, the first space (with the reinforcing webs) may be thicker than the second space. The first side wall and the middle wall may be spaced 2-10 cm apart, e.g., 4 cm apart. The middle wall and the second side wall may be 1-5 cm apart, e.g., 2 cm apart.

The panel unit may be sized according to an intended size or configuration of the building which the panel unit will be used to construct. A standard panel unit may be 472 mm wide and may be any practicable length.

The reinforcing webs in the first space may be spaced equal distances apart. The reinforcing webs may be spaced 5 cm to 0.2 m apart, e.g., 75 cm apart.

The second space may also include some support webs extending between the middle wall and the second side wall, but not as many reinforcing webs as there are in the first space. The support webs (if present) in the second space may be oblique or inclined relative to an upright axis. The second space may thus define a plurality of hollow cavities or sub-cavities between the support webs, the hollow cavities each operable to receive an insulation insert. The second space may include locating ridges to locate an insulation insert therein.

The insulation insert (referred to as the wall insulation insert) may be thin. The wall insulation insert may be planar, and panel-like or strip-like, depending on the size and shape cavity. The wall insulation insert may be made of fire resistance plaster board or other fire resistance material.

The wall insulation insert may have one or more of the following insulation properties:

- fire resistance sufficient to meet building codes/regulations in the jurisdiction in which it is being used;
- thermal insulation; and/or
- sound insulation.

(It should be noted that it may not necessarily be required to locate a building insert in each hollow cavity. For example, a building may have both exterior walls and interior walls. It may be a building regulation or code in a particular jurisdiction that outer walls must have certain characteristics, e.g., a minimum degree of fire resistance. Thus, it may be appropriate to place insulation inserts in the hollow cavities of the panel units forming the exterior walls, but not in the hollow cavities of the panel units forming the interior walls. In this fashion, costs and complexity can be reduced by only applying the insulation inserts to walls where they are required.)

The connection interfaces may be complemental but opposite. One end of the panel unit may have a male connection interface while the other end may have a female connection interface. Thus, a particular connection interface (e.g., a female connection interface) of one panel unit may be operable to interface with, and connect directly to, an opposite connection interface (e.g., a male connection interface) of a similar or identical adjacent panel unit. Conversely, the same connection interfaces of panel units may not be capable of direct connection to each other; however, an adaptor unit may be provided (see further below).

The connection interfaces may provide a snap-fit. Thus, one connection interface may include a hook or latch member while the other may include a catch or detent member. At least one of the members may be resiliently deformable. The hook member may be resiliently deformable.

The connection interfaces may permit two adjacent panel units to be snapped together by sliding them together in a direction transverse to the edges. Usually, when the panel units are in an operatively upright position, this may entail sliding the panel units horizontally together and causing the respective connection interfaces to snap together. The connection interfaces may prevent or at least inhibit disconnection in the same transverse direction. If desired, the connection interfaces may be reinforced, e.g., by application of an adhesive or a cement.

The connection interfaces may be disconnectable (and connectable) by sliding the panel units in a direction parallel to the edges. Usually, when the panel units are in an operatively upright position, this may entail sliding the panel units vertically to lift one clear of the other.

The invention extends to a building system which includes a plurality of panel units as defined above.

The system may include an adaptor unit. The adaptor unit may be about the same thickness as the panel units but much narrower. The adaptor unit may comprise a body having a connection interface on each side. The connection interfaces may be matched, that is, both of the same type (e.g., both male connection interfaces).

Where the panel unit has complemental but opposite connection interfaces (e.g., male-female), it will not be possible to connect the same connection interfaces (e.g., female-female) directly to each other. Accordingly, two panel units may be connected to each other indirectly with the same (not opposite or complemental) connection interfaces by using the adapter unit as an intermediary. For example, two female connection interfaces provided on adjacent panel units may be interconnected by using opposite and complemental male connection interfaces provided on the adaptor unit.

The building system may include a pillar unit. The pillar unit may be square in cross-sectional profile and may provide four connection interfaces, one on each side. The connection interfaces on the pillar unit may all be the same, e.g., female. A panel unit may be connectable directly to the pillar unit using a complemental connection interface, e.g., male on the panel unit to female on the pillar unit. Instead, the panel unit may be connected indirectly to the pillar unit using the same (not complemental) connection interface via the adaptor unit.

The pillar unit may be operable to create;

- a four-way junction, when four panel units are connected directly or indirectly to all four connection interfaces;
- a three-way or T-junction, when three panel units are connected directly or indirectly to three of the connection interfaces; and
- a two-way or L-shaped junction, when two panel units are connected directly or indirectly to two adjacent connection interfaces.

The pillar unit and/or the adaptor unit may be of the same material as the panel unit, e.g., moulded thermoplastics.

The pillar unit may define a hollow interior to receive an insulation insert. The pillar insulation insert may be shaped or sized differently from the building insulation insert. The hollow interior may be cruciform or X-shaped. Accordingly, the hollow interior may receive differently shaped pillar insulation inserts. In one example, the hollow insulation insert may be a flat strip, thus being able to be orientated in the X-shaped hollow in one of two orientations. The strip may be orientated co-planar with an adjacent panel unit, thus being parallel with the hollow cavity of that panel unit, thereby to provide continuous or near-continuous insulation.

The building system may include a roof support unit. The roof support unit may have an inclined top surface.

The system may include a centre beam unit, for use at an apex of a roof. The centre beam unit may comprise:

- a base;
- an elongate beam member projecting upwardly from the base; and
- a pair of declined wing members projecting outwardly and downwardly from the beam member.

The system may include other structural units. The system may include one or more of:

- a floor beam unit;
- a T combiner unit;

a cover strip for connection to an unused pillar connection interface;

a door adaptor unit; and/or a window adaptor unit.

Some or all of the units may include mechanical connection formations, such as tongue and groove, hook and catch, frictional interference fits, etc.

Some or all units may still include cladding, if desired.

The invention extends to a method of building, the method including:

connecting together a plurality of panel units, as defined above; and inserting an insulation insert into the hollow cavity of at least one of the panel units, thereby to insulate the panel unit.

The step of inserting may be done prior to connection of the panel units, during connection, or after connection.

The invention extends to a building or structure comprising the panel units as defined above.

BRIEF DESCRIPTION OF DRAWINGS

The invention will now be described, by way of example, with reference to the accompanying diagrammatic drawings.

In the drawings.

DETAILED DESCRIPTION OF EXAMPLE EMBODIMENTS

The following description of the invention is provided as an enabling teaching of the invention. Those skilled in the relevant art will recognise that many changes can be made to the embodiment described, while still attaining the beneficial results of the present invention. It will also be apparent that some of the desired benefits of the present invention can be attained by selecting some of the features of the present invention without utilising other features. Accordingly, those skilled in the art will recognise that modifications and adaptations to the present invention are possible and can even be desirable in certain circumstances, and are a part of the present invention. Thus, the following description is provided as illustrative of the principles of the present invention and not a limitation thereof.

Figure 1:
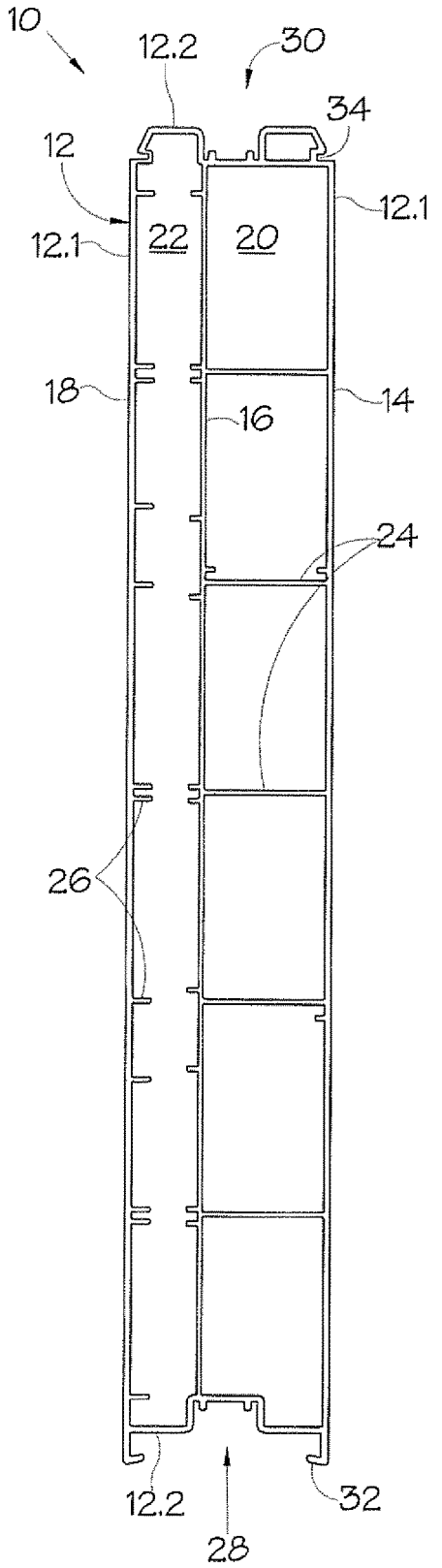
FIG. 1 shows a top plan view of a panel unit in accordance with the invention which forms part of a building system in accordance with the invention.

FIG. 1 shows a building unit, and specifically a panel unit 10, in accordance with the invention. The panel unit 10 has a body 12 made of thermoplastic. The panel unit 10 is about 472 mm wide×indefinite length×70 mm thick. The body 12 has two major side faces 12.1 and two minor end faces 12.2 at the ends of, and between, each side face 12.1.

The panel unit 10 comprises three walls 14-18, namely, a first side wall 14, a middle wall 16, and a second side wall 18. The walls 14-18 are thin and planar. The walls 14-18 are transversely spaced a short distance apart thereby to define two spaces 20-22, namely a first space 20 defined between the first side wall 14 and the middle wall 16, and a second space 22 defined between the middle wall 16 and the second side wall 18.

A plurality of transversely extending reinforcing webs 24 extend between the first side wall 14 and the middle wall 16 in the first space 20. The webs 24 impart stiffness and structural rigidity to the panel unit 10. In contrast, the second space 22 does not include webs, or includes fewer webs. Accordingly, the second space 22 thus defines a hollow cavity (or a series of hollow cavities) extending across a majority of the panel unit 10. The hollow cavity 22 is configured to receive a matched planar insulation insert 25 thereby to impart insulating, in particular, fire resistance properties to the panel unit 10 greater than those of the thermoplastic material alone.

Figure 2:
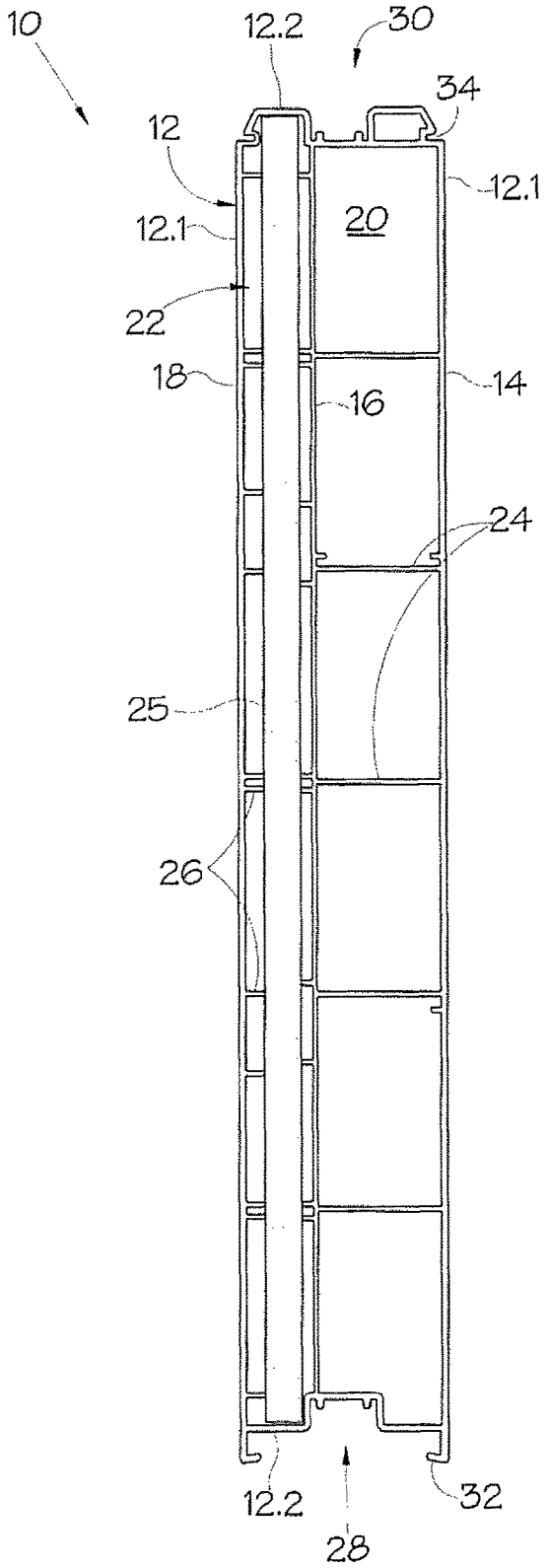
FIG. 2 shows a top plan view of the panel unit of FIG. 1 including an insulation insert.

FIG. 2 shows the insulation insert 25 located in the hollow cavity 22. The insulation insert 25 need not always be provided in the hollow cavity 22—it may depend on the position of the panel unit 10 with a building whether or not insulation is required. The insulation insert 25 is simply slid into the cavity 22 by hand and retained in place by a series of locating ridges 26 within the cavity 22.

A connection interface 28-30 is provided at each end 12.2 of the panel unit 10. The connection interfaces 28-30 are complemental but opposite. The connection interface 28 on one end face 12.2 is a female interface and has a pair of opposed resiliently deformable hook members 32. The other connection interface 30 on the other end face 12.2 is a male connection interface and has a pair of opposite catch members 34 operable to receive the hook formations 32 and prevent transverse withdrawal thereof.

Figure 3:
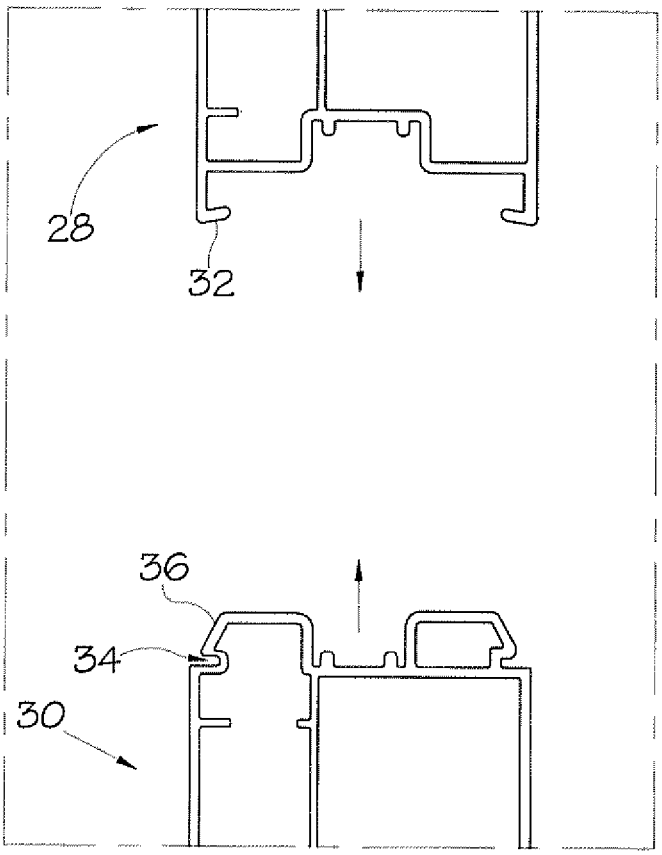
FIG. 3 shows ends of two adjacent panel units of FIG. 1 not yet connected.
Figure 4:
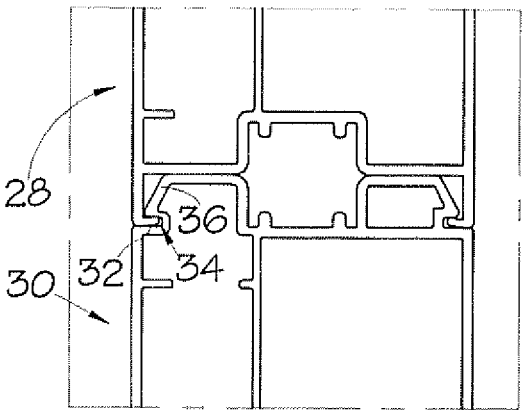
FIG. 4 shows the ends of the two adjacent panel units of FIG. 3 connected.

FIGS. 3-4 show the interconnection of the two connection interfaces 28-30 from two separate adjacent panel units 10 in more detail. The two connection interfaces 28-30 can engage and latch by transversal insertion of one into the other. An inclined surface 36 on the male connection formation 30 deforms the hook member 32 gently outwardly until it snaps into place in the catch member 34 where it cannot be withdrawn in the opposite direction. (The two panel units 10 can be separated by sliding them apart in a direction parallel to the ends 12.2, but not transversely away from the ends 12.2.) In this fashion, an indefinite number of panel units 10 can be connected end-to-end in a line to form a wall or other linear building structure.

Figure 5:
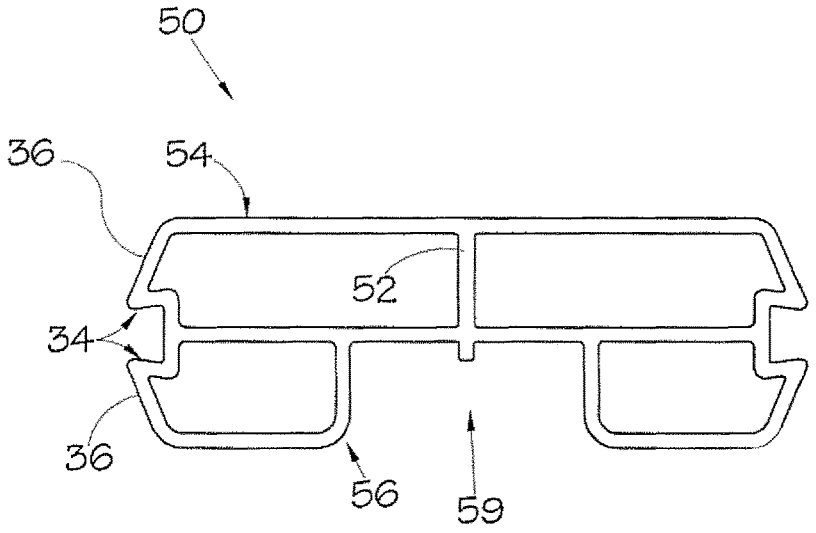
FIG. 5 shows a top plan view of an adaptor unit forming part of the building system.

FIG. 5 shows an adaptor unit 50 which has a body 52 made of thermoplastic material (like that of the panel unit 10). The body 52 defines opposite connection interfaces 54-56 which, in this example, are both male connection interfaces and are similar or identical to the male connection interface 30 of the panel unit 10. Each connection interface 54-56 has an oblique face 36 and a catch member 34 arranged rearwardly therefrom.

The adaptor 50 may be used as part of a building system, in accordance with the invention, including a plurality of the panel units 10.

Figure 6:
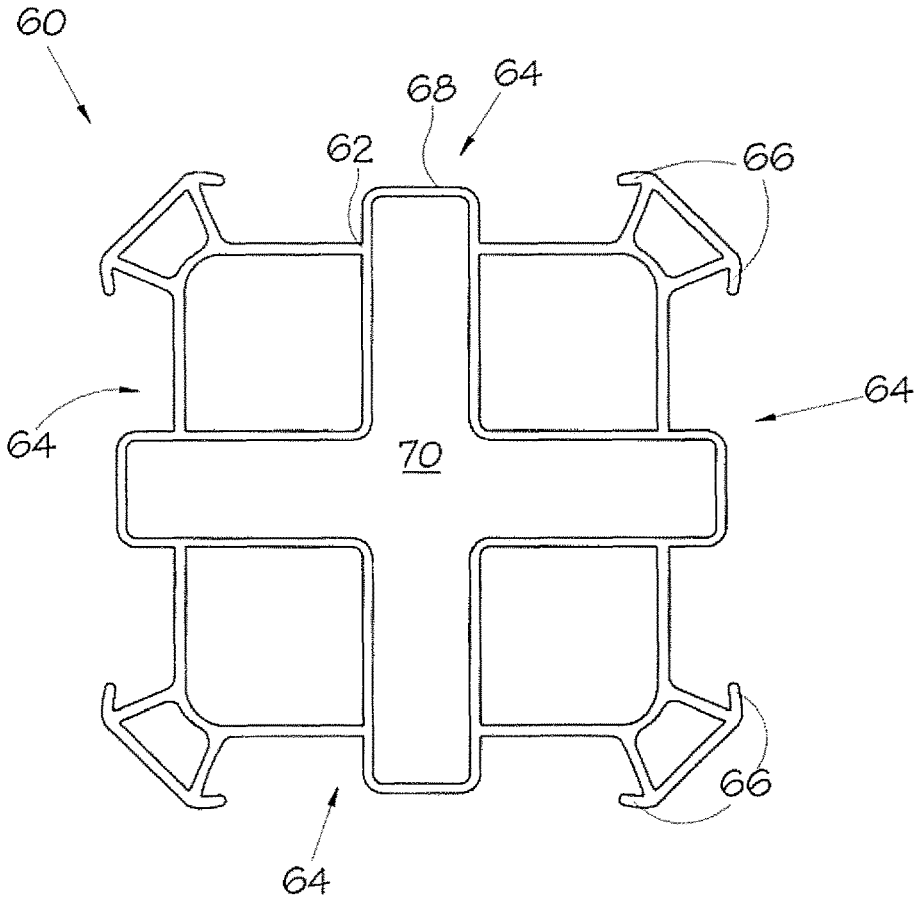
FIG. 6 shows a top plan view of a pillar unit forming part of the building system.

FIG. 6 shows a top plan view of a pillar member 60 used in the building system. The pillar member 60 has a generally square body 62 with a connection interface 64 at each of the four sides. Each connection interface 64 is similar to the female connection interface 28 of the panel unit 10, except that hook members 66 are configured slightly differently and that a ridge 68 is provided in the middle of the connection interface 64.

Each connection interface 64 can therefore receive either the male connection interface 30 of the panel unit 10 or the male connection interface 56 of the adaptor unit 50. (The connection interface 64 cannot receive the other male connection interface 54 of the adaptor unit 50 because the ridge 68 cannot be accommodated.)

The body 62 defines a cruciform hollow interior 70 which can accommodate an insulating strip orientated in one of two directions (see further below) or an x-shaped insulation insert.

Figure 7:
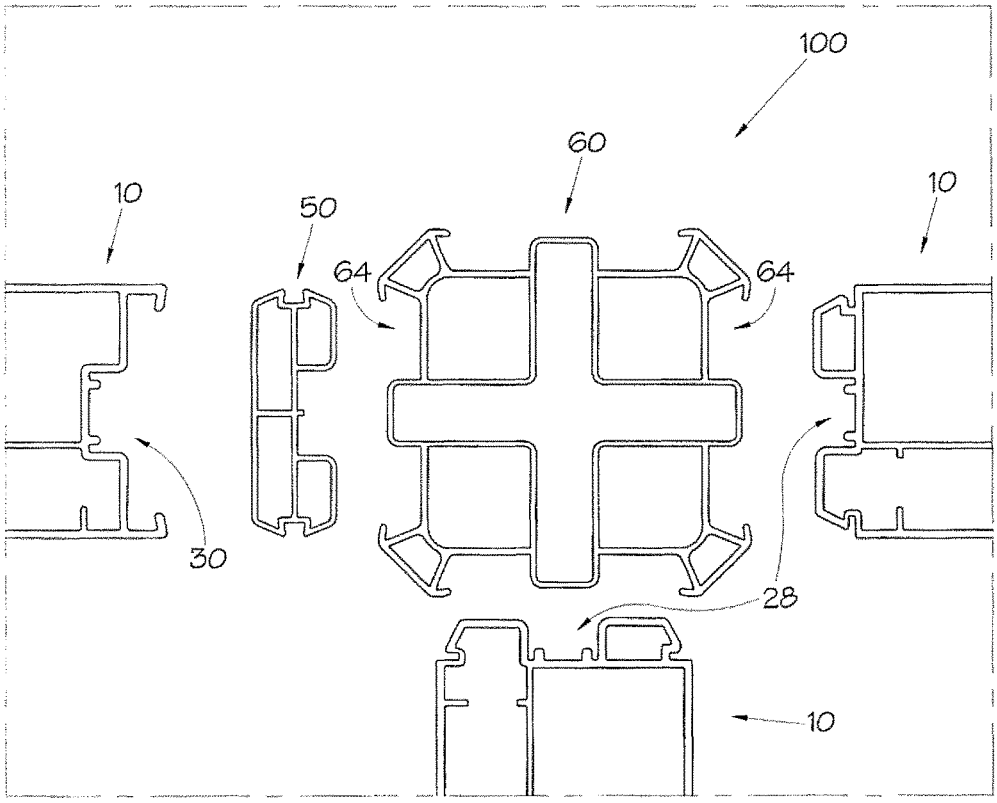
FIG. 7 shows an exploded view of a T-junction forming part of the building system.
Figure 8:
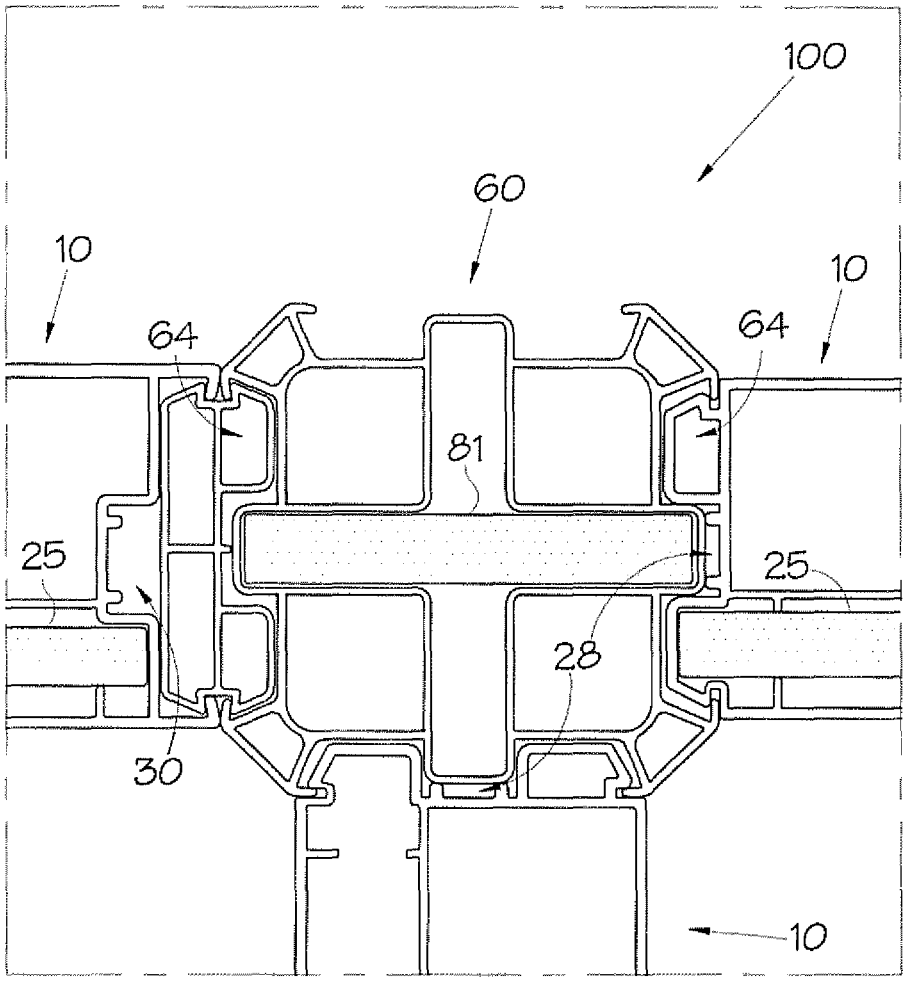
FIG. 8 shows an assembled view of the T-junction of FIG. 7 with insulation inserts.

FIGS. 7-8 show part of an example system 100 of three panel units 10, an adaptor unit 50 and a pillar unit 60 arranged to form a T-junction with partial insulation. In this T-junction, only three connection interfaces 64 of the pillar unit 60 have been used. Because the pillar unit 60 has only four female connection interfaces 64, it can only accept complemental male connection interfaces from the units 10, 50 which are connected to it.

Two panel units 10 (on the right and the bottom of the pillar unit 60 in the figure) are connected directly to the pillar unit 60 using their complemental male connection interfaces 30. The ridges 68 of the pillar unit 60 are accommodated neatly within the corresponding grooves of the panel units 10.

The orientation of the panel unit 10 on the left might not have permitted its male connection interface 30 to be adjacent the pillar unit 60. Accordingly, the adaptor unit 50 is used to allow the female connection interface 28 of the panel member 10 to connect indirectly with the pillar member 60. The adaptor unit 50 must be orientated such that its groove 59 accommodates the ridge 68 of the pillar unit 60.

FIG. 8 shows the system 100 assembled. The respective units 10, 50, 60 are moved transversely (relative to the height axis or their upright ends 12.2) to snap together by engagement of the hook members 32 with the catch members 34. (Instead, if desired, the units 10, 50, 60 could be slid longitudinally (relative to the edges 12.2) together but it will usually be more practical to snap them together.)

FIG. 8 also illustrates the arrangement of insulation inserts 25, 81. The panel insulation inserts 25 have been placed in the hollow cavity 22 of each of the left and right panel units 10. A pillar insulation insert 81, in the form of an elongate strip, has been placed in the cruciform hollow interior 70 to be parallel with the other insulation inserts 25. Thus, a continuous fire resistant barrier 25, 81 has been created along a wall (formed by the left and right panel units 10) which may be deemed to require non-inflammable or other insulating properties. If desired, any uninsulated units (e.g., the adaptor unit 50) could include cladding in the form of a metal strip or the like.

By varying the arrangement of units 10, 50, 60, other configurations can be achieved, including a four way junction (with a panel unit 10 connected directly or indirectly via an adaptor unit 50 to each side of the pillar unit 60), two way junction, whether L-shaped or straight. However, use of an adaptor 50 only may be a more efficient way to achieve a straight junction.

FIGS. 9-14 show various additional constructional units 110-160.

Figure 9:
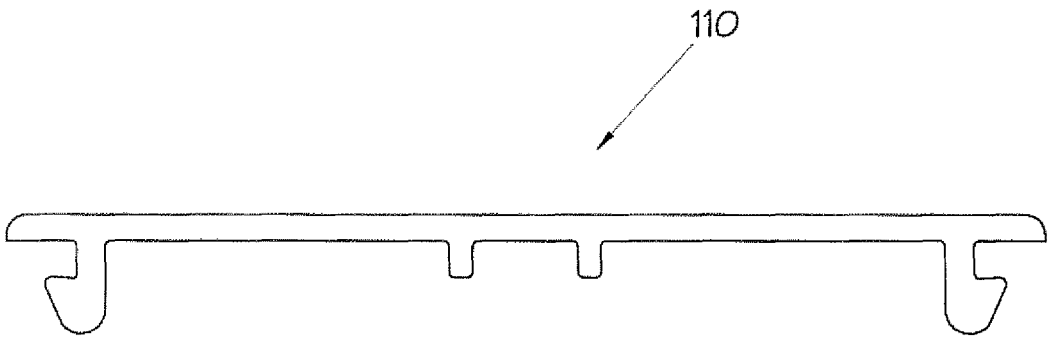
FIGS. 9-14 show plan or elevation views of a selection of additional constructional units which may be used in the building system.

FIG. 9 shows a pillar blank cover unit 110 which can be used to cover unused connection interfaces of the pillar unit 60. For example, in FIGS. 7-8, the pillar blank cover unit 110 may be applied to the connection interface 64 at the top where no panel unit 10 or adaptor unit 50 is connected. This closes off any unused connection interfaces 64, creating a neater finish.

Figure 10:
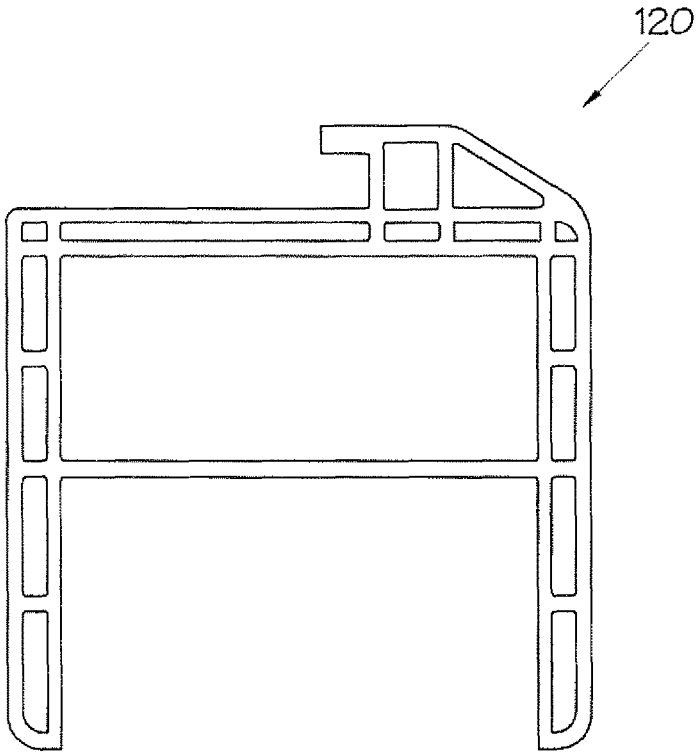

FIG. 10 shows a door adaptor unit 120 which can be to create part of a door frame.

Figure 11:
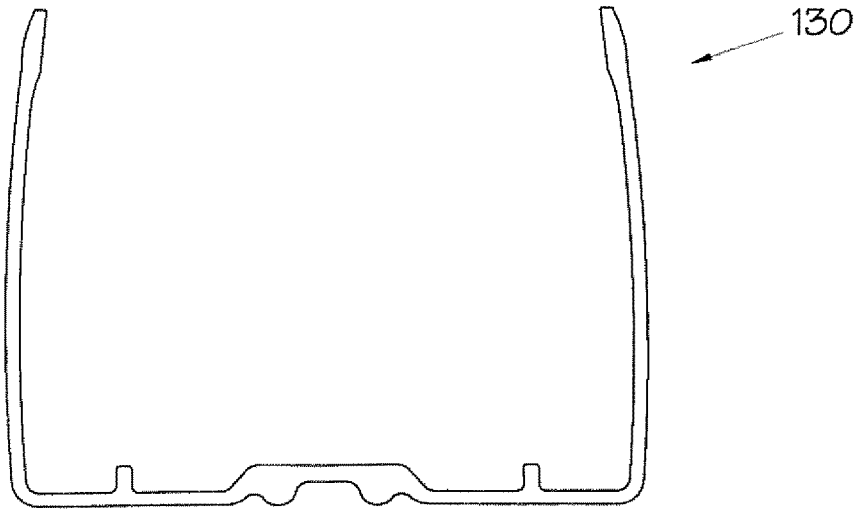
Figure 12:
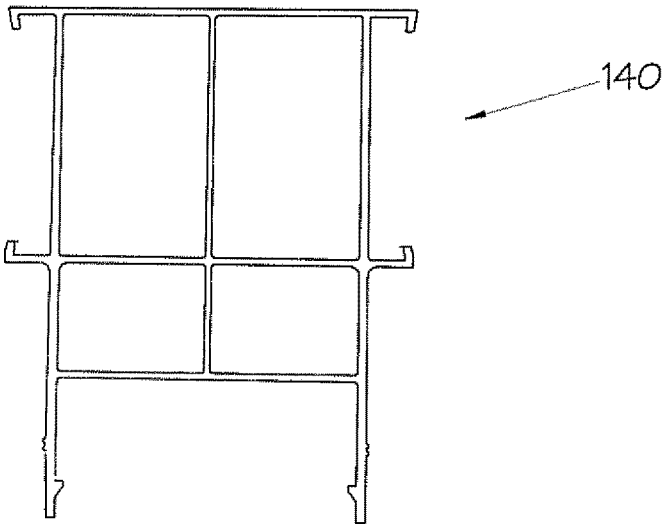

FIGS. 11-12 show respectively a floor beam unit 130 and a T combiner unit 140 which can be used to impart desired finishes to the system 100.

Figure 13:
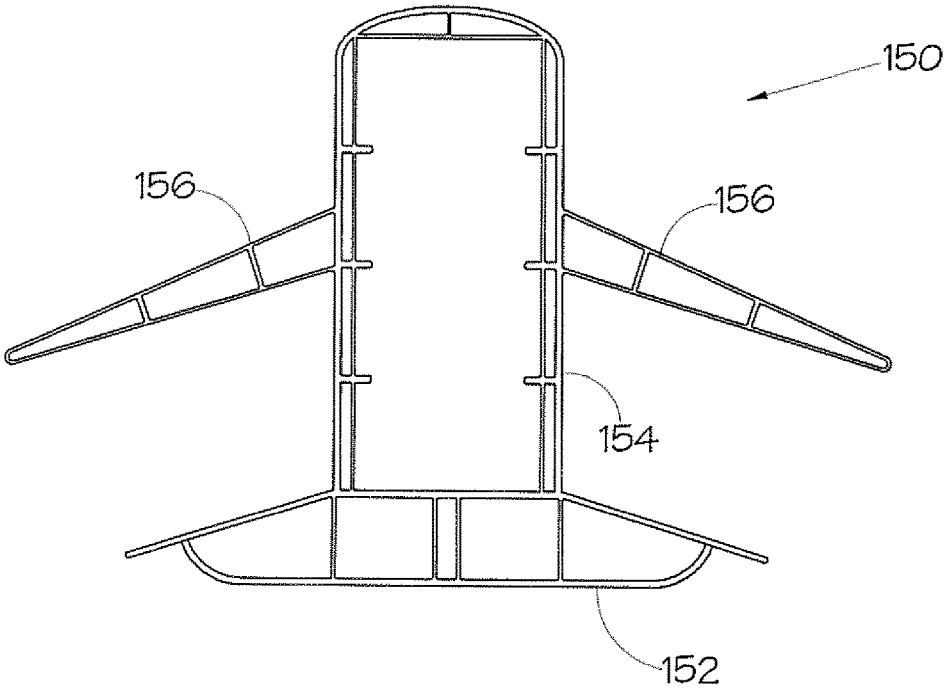

FIG. 13 shows a centre beam unit 150 which comprises a base 152, an elongate beam member 154 projecting upwardly from the base 152 and a pair of declined wing members 156 projecting outwardly and downwardly from the beam member 154. The centre beam unit 150 is used to create an apex of a roof.

Figure 14:
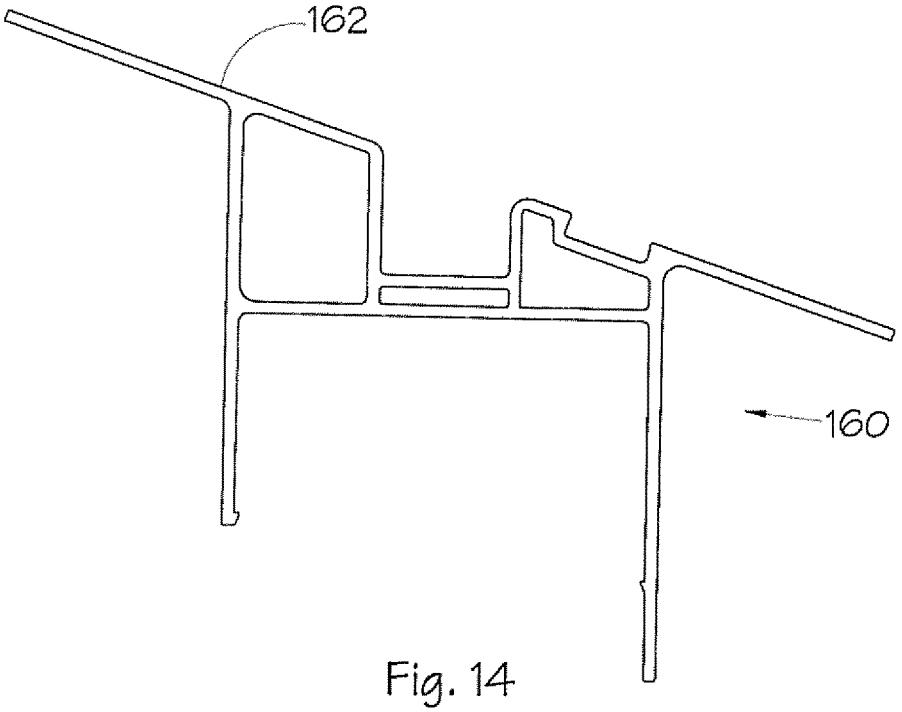

FIG. 14 shows a roof wall beam unit 160 which has an inclined top surface 162. The roof wall beam unit 160 and the centre beam unit 150 together serve to locate and support roof panels (not illustrated).

Figure 15:
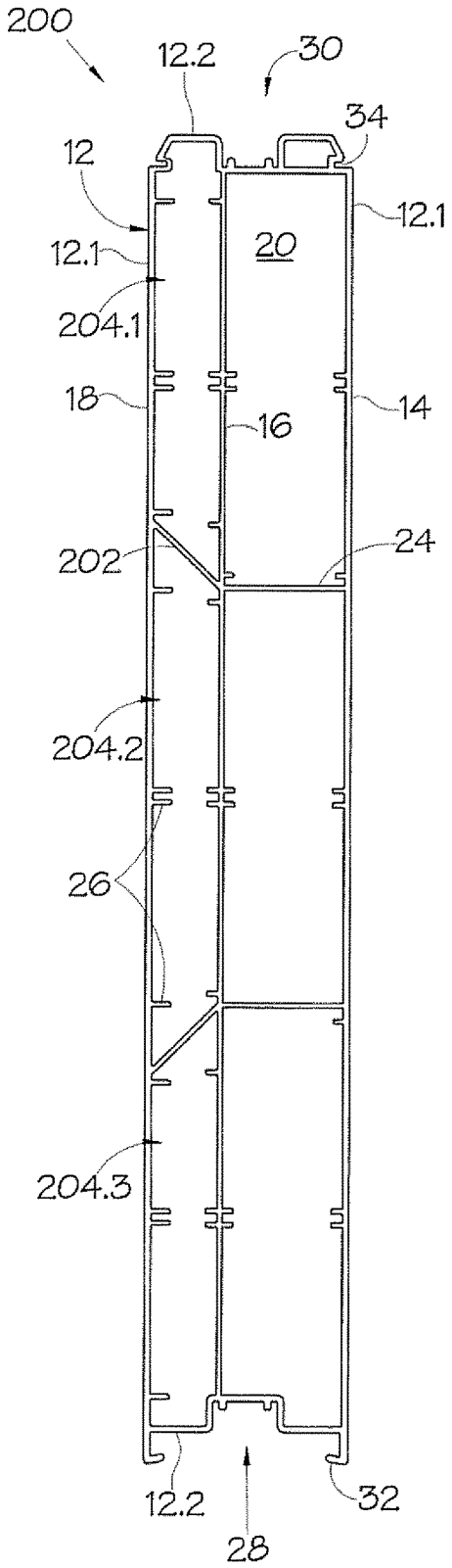
FIG. 15 shows a top plan view of an alternative panel unit in accordance with the invention.

FIG. 15 shows an alternative embodiment of a panel unit 200, in accordance with the invention. The panel unit 200 is similar to that of FIG. 1, but in this embodiment, a second space 204 has obliquely extending webs 202 thus defining a plurality of smaller hollow cavities 204.1-204.3 (collectively forming the second space 204). This panel unit 200 may be desirable from a structural perspective or may be necessitated by limitations in extrusion or other manufacturing techniques.

Figure 16:
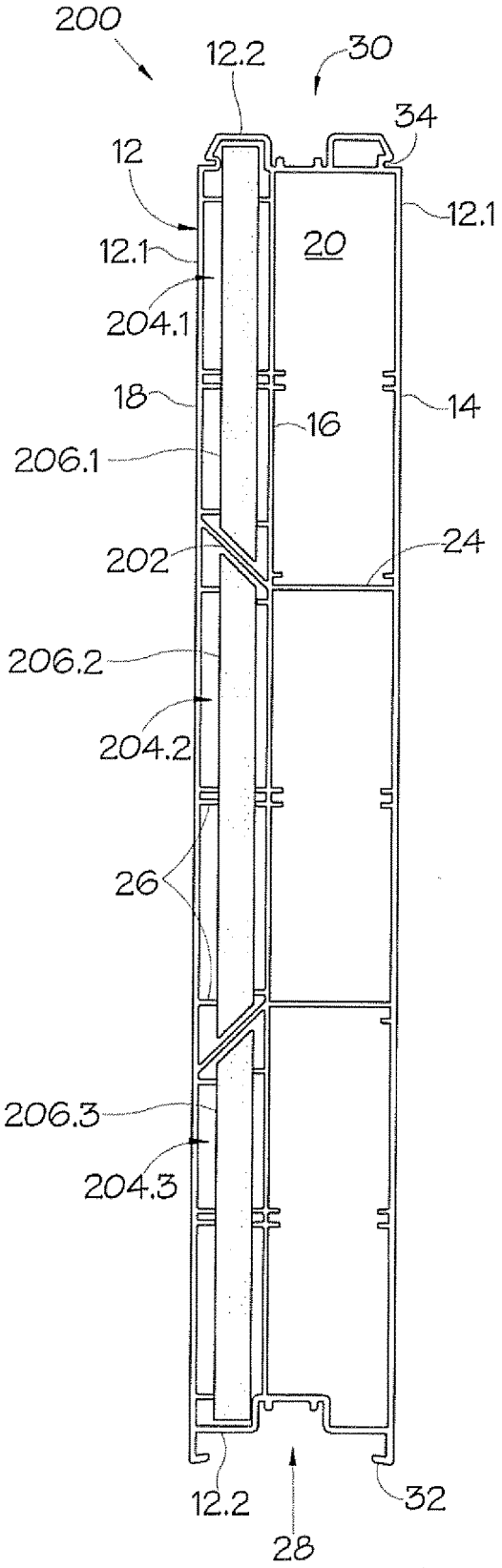
FIG. 16 shows a top plan view of the panel unit of FIG. 15 including plural insulation inserts.

FIG. 16 shows the panel unit 200 including a plurality of insulation inserts 206.1-206.3 respectively placed in the hollow cavities 204.1-204.3. The outer insulation inserts 206.1, 206.3 are the same shape (with one being upside down relative to the other) and the middle insulation insert 206.2 is a different shape. The webs 202 are oblique or inclined to assist in the maintenance of a continuous fire-proof barrier.

Figure 17:
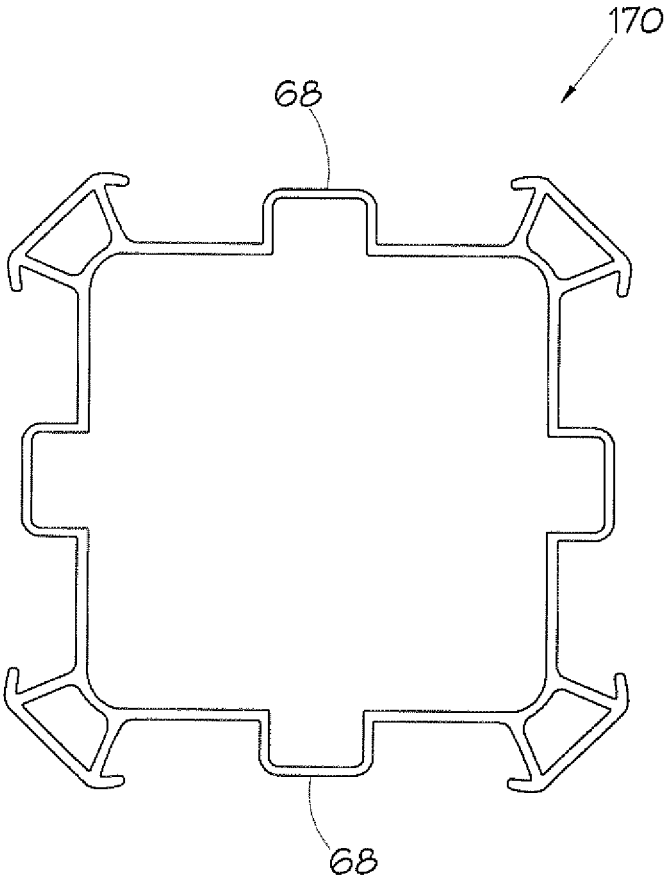
FIG. 17 shows a top plan view of another embodiment of a pillar unit forming part of the building system.

FIG. 17 shows a top plan view of a second embodiment of a pillar member 170, similar to the pillar member 60 as shown in FIG. 6. The pillar member 170 excludes the cruciform hollow interior 70 as shown in FIG. 6 but still includes the ridges 68. The pillar insulation insert 81 can be accommodated by the ridges 68 alone.

Figure 18:
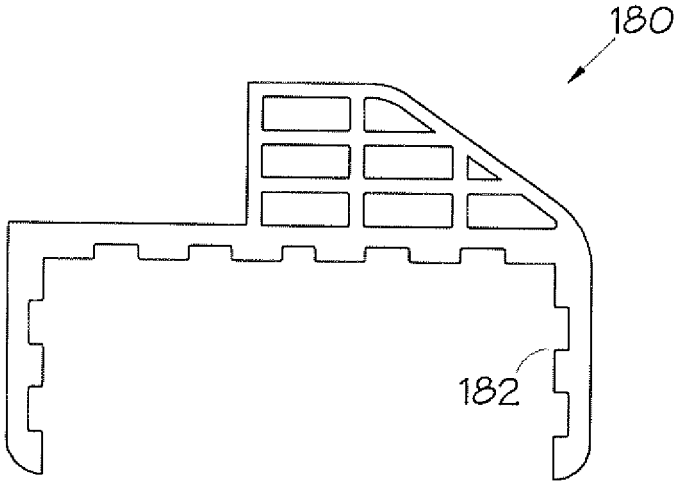
FIG. 18 shows an elevation view of a window adaptor unit forming part of the building system.

FIG. 18 shows a window adaptor unit 180, which has a grooved frame 182 which serves to locate and support windows (not illustrated).

Figure 19:
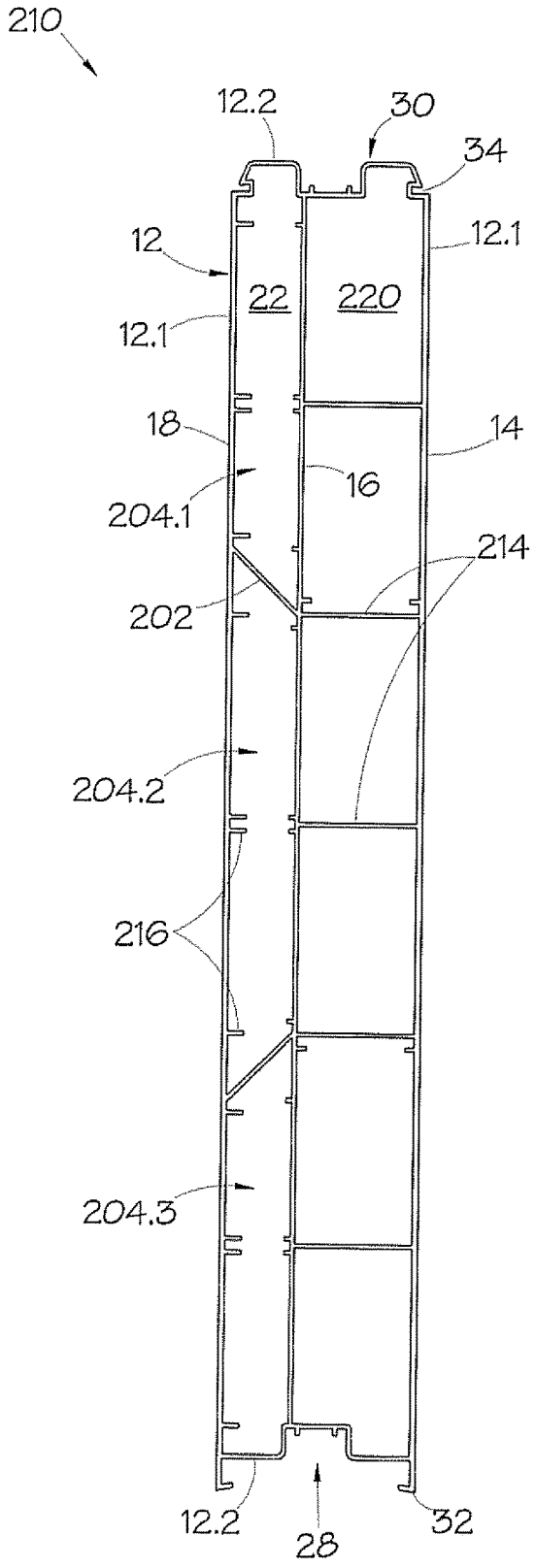
FIG. 19 shows a top plan view of a third embodiment of a panel unit in accordance with the invention.

FIG. 19 shows a third embodiment of a panel unit 210, in accordance with the invention. The panel unit 210 is similar to those of FIGS. 1 and 15, but in this embodiment, a differing configuration of reinforcing webs 214 is provided in a first space 220. Also, the configurations of locating ridges 216 differ slightly. This panel unit 210 may be desirable from a structural perspective or may be desired for ease of extrusion/moulding or other manufacturing technique.

The invention as exemplified herein provides several advantages. The provision of hollow cavities 22, 70 to accommodate an insulation insert 25, 81 (or any other kind of insulating material, e.g., stuffing). This allows use of relatively cheap and easy to manufacture units (e.g., the panel unit 10) to be used without the need for additional cladding. Where insulation is not required, it need not be used. Where insulation is required, it can simply be inserted or otherwise provided in the cavities 22, 70. This procedure is quick and may be done without special tools or skills. It does not add significantly to construction time.

The invention claimed is:

1. A modular building unit made of a polymeric material for use in constructing a building, the building unit comprising:

a planar body having two major side faces and two ends between each side face; and a connection interface provided at each of the ends, thereby to connect building units with complemental connection interfaces, wherein the body further comprises:

three walls comprising a first side wall, a middle wall, and a second side wall arranged side-by-side and transversely spaced from each other, the three walls thus defining two spaces therebetween, with a first space defined between the first side wall and the middle wall and a second space defined between the middle wall and the second side wall; and a plurality of reinforcing webs extending between the first side wall and the middle wall in the first space, thereby to provide structural support to the building unit, wherein the second space defines at least one hollow cavity extending across at least some of the building unit and operable to receive a matched insulation insert thereby to impart insulating properties to the building unit greater than those of the polymeric material alone, wherein the second space includes locating ridges to locate the insulation insert therein, wherein the second space includes at least one support web extending between the second side wall and the middle wall, the second space thus being divided into a plurality of laterally spaced apart sub-cavities, and wherein the support web or at least one of the support webs is inclined about an upright axis, thereby to increase overlap of ends of adjacent sub-cavities and any insulating inserts therein.

2. The modular building unit as claimed in claim 1, wherein the first side wall and middle wall are spaced further apart than the middle wall and the second side wall, the second space thus being narrower than the first space.

3. The modular building unit as claimed in claim 1, wherein the insulation insert is receivable in each one of the sub-cavities.

4. The modular building unit as claimed in claim 1, wherein the locating ridges are upright and are configured to space the insulation insert from the second wall and the middle wall.

5. The modular building unit as claimed in claim 1, wherein the connection interfaces are complemental but opposite, and wherein one end of the unit includes a male connection interface and the other end includes a female connection interface.

6. The modular building unit as claimed in claim 1, wherein the male and female connection interfaces are resilient and provide a snap-fit connection.

7. An assembled building unit comprising the modular building unit as claimed in claim 1, which includes at least one insulating insert within the second space.

8. The assembled building unit as claimed in claim 7, in which the insulating insert is fire resistant.

9. A building system which includes a plurality of modular building units according to claim 1.

10. The building system as claimed in claim 9, which includes an adaptor unit comprising a body having either a male or female connection interface on each one of opposite sides for use as an intermediary to connect male-male or female-female connection interfaces of two modular building units together.

11. The building system as claimed in claim 9, which includes a pillar unit which is square in cross-sectional profile and which provides four connection interfaces, one on each side, for complementary connection to a modular building unit or any other unit in the system.

12. The building system as claimed in claim 9, which includes a roof support unit with an inclined top surface for locating and supporting roof panels.

13. The building system as claimed in claim 9, which includes a centre beam comprising:

a base;

an elongate beam member projecting upwardly from the base; and a pair of declined wing members projecting outwardly and downward from the beam member, for use at an apex of a roof.

14. The building system as claimed in claim 9, which includes one or more of the following structural units:

a floor beam unit;

a T combiner unit;

a cover strip for connection to an unused pillar connection interface;

a door adaptor unit; and a window adaptor unit.

15. A method of constructing a building from modular building units, the method including:

connecting together a plurality of building units as claimed in claim 1; and inserting an insulation insert into the second space of at least one of the building units, thereby to insulate the building unit.

16. A building or structure comprising a plurality of the modular building units as claimed in claim 1.

* * * * *